US005249758A

United States Patent [19]

Müller et al.

[11] Patent Number: 5,249,758

[45] Date of Patent: Oct. 5, 1993

[54] APPARATUS FOR THE CONTINUOUS WINDING OF A WEB OF SHEET-LIKE MATERIAL, IN PARTICULAR A PAPER WEB

[75] Inventors: Gernot Müller, Kusterdingen; Werner Schmid, Pliezhausen, both of Fed. Rep. of Germany

[73] Assignee: Sulzer-Escher Wyss GmbH, Ravensburg, Fed. Rep. of Germany

[21] Appl. No.: 635,617

[22] PCT Filed: May 12, 1989

[86] PCT No.: PCT/DE89/00303

§ 371 Date: Sep. 9, 1991

§ 102(e) Date: Sep. 9, 1991

[87] PCT Pub. No.: WO90/00511

PCT Pub. Date: Jan. 25, 1990

[30] Foreign Application Priority Data

Jul. 8, 1988 [DE] Fed. Rep. of Germany ... 8808823[U]

[51] Int. Cl.[5] ..... B65H 18/10; B65H 18/16

[52] U.S. Cl. ..... 242/65; 242/67.1 R

[58] Field of Search ..... 242/65, 66, 75.2, 67.1 R, 242/67.2

[56] References Cited

U.S. PATENT DOCUMENTS

| | | | |
|---|---|---|---|
| 3,610,545 | 10/1971 | Reifenhauser | 242/65 X |
| 4,049,212 | 9/1977 | Yamaguchi et al. | 242/65 X |
| 4,634,068 | 1/1987 | Malkki et al. | 242/65 |
| 4,744,526 | 5/1988 | Kremar | 242/65 |

FOREIGN PATENT DOCUMENTS

| | | |
|---|---|---|
| 0026335 | 4/1981 | European Pat. Off. . |
| 1560039 | 9/1969 | Fed. Rep. of Germany . |
| 3326701 | 2/1985 | Fed. Rep. of Germany . |
| 2178593 | 11/1973 | France . |
| 2532920 | 3/1984 | France . |

*Primary Examiner*—John M. Jillions

*Attorney, Agent, or Firm*—Wolf, Greenfield & Sacks

[57] ABSTRACT

The apparatus for the continuous winding of a web, in particular a paper web, onto a motor-driven roll core can also continue to be operated during the change of the roll core. A guiding drum serves as a support for the empty roll core during the change and is used for guiding the web. The guiding drum is continuously maintained at a distance remote from the winding. A pressing roll serves to press the web against the winding, a setting signal for a drive of a roll support carriage being derived from the position of the pressing roll, with the position changing based upon an increase in size of the winding.

9 Claims, 1 Drawing Sheet

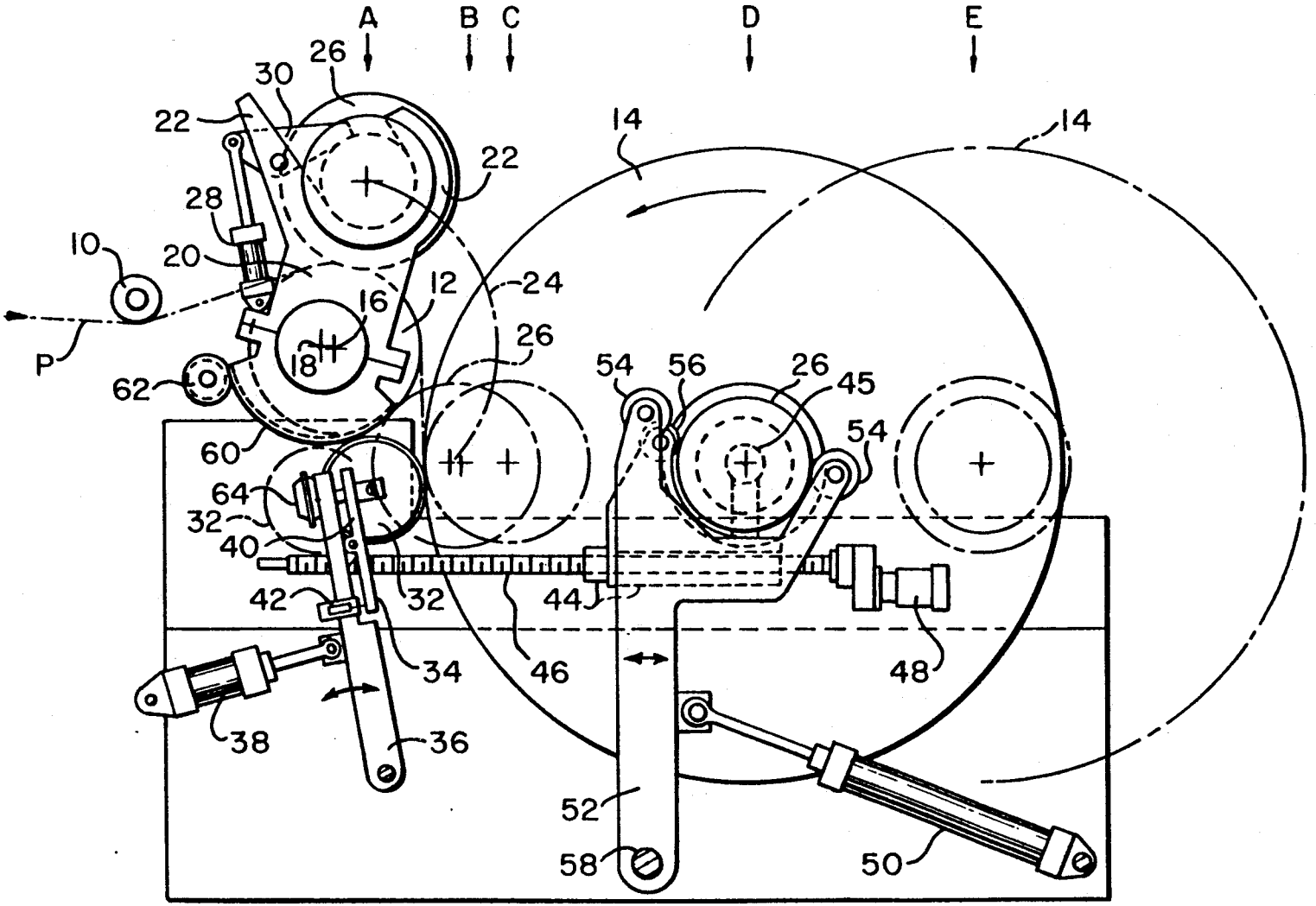
A
B
C
D
E
10
12
14
14
16
18
20
22
22
24
26
26
26
28
30
32
32
34
36
38
40
42
44
45
46
48
50
52
54
54
56
58
60
62
64
P

APPARATUS FOR THE CONTINUOUS WINDING OF A WEB OF SHEET-LIKE MATERIAL, IN PARTICULAR A PAPER WEB

BACKGROUND OF THE INVENTION

The invention relates to an apparatus for the continuous winding of a web of sheet-like material, in particular a paper web onto a roll core, comprising a carrying drum guiding the web, a transfer device for transferring the empty roll core out of a holding position into an operative position, a drive for the roll core, a support and transport device operative during the winding operation for moving the roll core to discharge the fully wound roll core, and a device for transferring the conveyed web from the fully wound roll core onto an empty roll core.

In connection with such an apparatus, a so-called poperoller is known. The continuous winding of a paper web is possible with such a poperoller. In this case, the paper web is guided around a carrying drum and then wound onto a roll core, a so-called tambour. The winding drive is carried out such that the previously mentioned roll core is driven and lies at the outer periphery of the ensuing winding. A swivel arm is arranged approximately concentrically to the carrying drum, by means of which swivel arm an empty roll core can be brought into the winding position when the previous roll core has been fully wound with the paper web. The transfer of the fully wound paper web onto the empty roll core ensues automatically without having to completely interrupt the operation as a whole. The accomplishing of the winding drive via the carrying drum at the periphery of the ensuing winding is associated with certain disadvantages regarding the winding quality.

The U.S. Pat. No. 4,744,526 describes a winding apparatus which is also able to work continuously during roll changes, the winding apparatus comprising a carrying drum.

A winding apparatus for winding pressure-sensitive paper is known from DE-A-29 35 743 or EP-A-26 335. This winding apparatus makes use of a first pressing roll which is held at a distance from the winding. In the direction of feed of the paper web, a second pressing roll having a soft pressure applying surface is provided behind this first pressing roll. On account of the distance between the first pressing roll and the winding, air is drawn into the winding, particularly at high machine speeds. The drawing-in of this air is prevented by the second pressing roll. Thus, the second pressing roll having a soft surface lies against the surface of the winding under slight pressure. When the winding increases, the position of the second pressing roll is shifted and a switch is actuated which serves to move forward the roll core on which the web is being wound. Thus, a gentle, soft winding without the inclusion of air results. This means that although a good winding quality is provided, the possibility of continuing to wind during roll changes is not provided. For example, no carrying drum is included which is important for the continuous operation for roll changes.

Should the continuously operating roller according to U.S. Pat. No. 4,744,526 be combined with the teaching of the application referred to above, a very complicated apparatus would result.

In DE-A 1 560 039, a different solution for achieving a uniformly applied pressure is suggested by means of the application of a withdrawal roll and a pressure roll. However, a continued winding during the roll change is also not possible in this case.

It is an object of the invention to achieve a soft winding process in connection with the poperoller-system initially mentioned in order to realize a homogenous and gentle winding process across the entire width of the winding.

This object is solved in accordance with the present invention in that the carrying drum is arranged as a guiding drum in such a manner that it is always located at a distance from the winding, that a pressing roll is provided behind the guiding drum in the running direction of the web and is arranged in such a manner that it always lies against the winding during operation, that the pressing roll is connected with a sensor for determining the increase in the winding, that the support and transport device for the roll core is connected with a drive controlled by the sensor, and that a separate winding drive is provided for rotating the roll core.

SUMMARY OF THE INVENTION

The invention consists in that the carrying drum actually used for driving the winding and the carrying axis has been changed in function into a guiding drum in order to feed the paper web guided in the gap between the pressure roll and the winding without air being enclosed in the winding. Thus, the poperoller-system known in itself must only be altered in such a way that a separate winding drive is provided for the roll core and a separate sensor-controlled pressing roll is added which lies gently against the winding, prevents the inclusion of air and enables a gentle winding in connection with the advantageous poperoller system by means of the sensor control and the corresponding transport of the roll core with the winding.

According to a preferred embodiment, the surface of the guiding drum has been roughened so that a particularly good guiding action of the carrying drum, changed in function into a guiding drum, is ensured, in fact together with the prevention of axial displacements of the web to be wound.

BRIEF DESCRIPTION OF THE DRAWINGS

The invention is described in more detail by means of a purely schematic embodiment shown in the drawing.

The only FIGURE shows a schematic side view of an apparatus for the continuous, soft winding of a paper web onto a roll core.

DETAILED DESCRIPTION OF THE PREFERRED EMBODIMENT

A paper web P is fed from the left in the drawing and runs over a guiding drum 12 after first being deflected about a roll 10 and then passes over the winding 14 already recognizable in the drawing.

The guiding drum 12 rotates about an axis 16. A swivel arm 20 having a holding fork 22 is pivotably arranged about an axis 18 slightly displaced with respect to the axis 16, as is indicated by the dash-dot circular curve 24. An empty roll core 26 is placed in the fork 22 in order to pivot this out of the position shown in the drawing into an operating position, as explained further below.

On the swivel arm 20, a cylinder 28 is arranged with which a supporting arm 30 can be activated in order to hold the roll core 26 in the fork 22 when the swivel arm 20 is pivoted in the manner previously described.

Beneath the guiding drum 12, a pressing roll 32 is located which is mounted to a swivel lever 36 by means of an auxiliary lever 34, the swivel lever 36 being pivotable to and fro by means of a cylinder 38. The auxiliary lever 34 is connected to the swivel lever 36 via a swivel axis 40 and has the pressing roll 32 arranged at its one end and acts with its other end together with an inductive transmitter (sensor) 42. The pressing roll 32 is spring-mounted to the auxiliary lever such that the pressure applied onto the winding can be adjusted.

Additionally, a horizontally displaceable guiding carriage 44 is provided on the roll core side facing the guiding drum 12, the carriage being driven parallel to both sides via a worm drive 46 and an associated motor 48. A transport lever 52 driven by a cylinder 50 is positioned adjacent to and in cooperation with the carriage. The guiding carriage 44 causes the forward movement of the roll core and the transport lever 52 effects the discharge of the fully wound roll core from the position D into the position E.

The transport lever is provided with holding rolls 54 arranged on opposite sides. The carriage 44 has a transport roll 56 lying on the left hand side of the carrying axis as seen in the drawing. The transport lever 52 is pivotable about a swivel axis 58. In other words, the carriage 44 moves horizontally along the worm drive 46 while the associated transport lever 52 and holding rolls 54 pivot on swivel axis 58 to follow the horizontally moving carriage 44, with the holding rolls 54 serving to maintain the roll core 26 upon the carriage 44.

The swivel arm 20 is provided with a toothed segment 60 at the lower part thereof, which segment is connected to a pinion drive 62. The roll core lying in the operative position can be rotationally coupled to a separate drive in such a manner that the drive does not ensue at the periphery of the winding. The separate drive in this embodiment comprises a drive member 45 (shown schematically) positioned proximate the guiding carriage 44 in engagement with a side of the roll core 26. It should be understood that any appropriate roll drive known to one skilled in the art can be utilized according to this invention. Finally, a diaphram cylinder 64 is arranged on the swivel lever 36 at the height of the pressure roller 32, the cylinder 64 serving to apply a sensitive, pneumatic pressure against the pressing roll. The surface of the guiding drum 12 is preferably roughened and thus prevents an axial displacement of the web, as the guiding roll 12 serves to exactly feed the web P between the pressure roll 32 and the winding 14.

The operating sequence of the depicted apparatus is described briefly as follows.

In the started position, the fully wound roll core guided between the guiding carriage 44 and the transport lever 52 lies in the position D. The roll core is still coupled to the winding drive and the pressing roll 32 lies against the winding. The inductive transmitter 42 regulates the actuator 48. The greater the deviation from the desired position, the larger the number of revolutions of the actuator. An empty roll core 26 already lies in the fork 22 of the swivel arm 20 and is ready for a transfer step.

When the roll core in the position D is fully wound, the pivoting of the swivel arm 20 is carried out. On account of the slightly eccentric arrangement of the axes 16 and 18, the peripheral surface of the empty roll core ends up on the periphery of the guiding drum 12 and is driven by this. The drive of the wound roll core in the position D is then suppressed such that a loop is blown between the guiding drum 12 and the finished winding 14 and the paper web is separated from one another in this region with the result that the leading end of the paper web P is laid about the empty roll core 26 and wound. The pressing roll 32 is then located in the condition in which it is pivoted away, as depected by dash-dot lines in the FIGURE. The roll core with the winding 14 is decelerated in the position D and the drive is disengaged. The guiding carriage 44 and the winding drive are then moved together from the position D to B and the finished winding is pushed out from D to E by means of the transport lever 52. The transport lever 52 is then pivoted in an empty condition back from E to B. The new roll core pivots to B, driven by means of the contact with the guiding drum. The guiding carriage 44 contacts the roll core 26 together with the winding drive in the position B, the transport lever 52 pressing the roll core against the guiding carriage 44. The winding drive then accelerates to the synchronous number of revolutions and is coupled. Finally, the pressing roll 32 contacts the winding and pivots into the operative position while the roll core is simultaneously transported together with the winding drive by means of the actuator into the position C, which is the initial operative position.

If the winding 14 increases with respect to its diameter in the ensuing winding step, then the pressure on the pressing roll increases, resulting in a pivoting of the auxiliary lever 34 and a reaction at the inductive transmitter. In dependence on the actuation of the inductive transmitter, a synchronous drive of the guiding carriage 44 and thus a synchronous, further transport of the winding 14 with the associated roll core 26 results.

What is claimed is:

1. An apparatus for forming a continuous winding of a web from a source onto a roll core comprising:

a roll core support, the support being movable from a loading position, wherein a roll core is loaded onto the support to a supporting position, wherein the roll core is located on the support during winding of the web onto the roll core, to a discharge position, wherein the roll core is discharged from the roll core support when fully wound;

a rotating guiding drum for directing the web from the web source to the roll core when the roll core is positioned on the roll core support in the supporting position;

a first drive for rotating the guiding drum at a predetermined time;

a movable pressing roll biased against a side of the web opposite a side that faces the roll core so that the web forms a winding on the roll core substantially free of air bubbles in the winding;

a sensor, interconnected with the pressing roll, the sensor detecting an increase in a size of the winding and the sensor generating a signal in response to the increase in size;

a second drive for moving the roll core support in response to the signal to change the position of the roll core relative to the pressing roll;

a third drive for rotating the roll core on the support at a predetermined time;

a roll core carrying arm constructed and arranged so that a roll core located in the carrying arm rotates in conjunction with and in response to the rotation of the guiding drum, the carrying arm including a pivot proximate and substantially parallel to an axis of rotation of the guiding drum, the arm moving on the pivot between a carrying position remote from the roll core support to an unloading position wherein the roll core is transferred onto the roll core support in the loading position at a predetermined time; and a fourth drive that moves the carrying arm from the carrying position to the unloading position, wherein the guiding drum is at all times positioned out of contact with the winding on the roll core when the roll core is located on the roll core support in the supporting position.

2. An apparatus according to claim 1, wherein the pressing roll is positioned on a swivel lever so that the pressing roll is adjustable, and further including an auxilliary lever for adjusting the pressing roll relative to the winding, the auxilliary lever being pivoted on the swivel lever and being in operative connection with the sensor.

3. An apparatus according to claim 1, wherein the roll core support comprises a guiding carriage, and further including a worm drive, the roll core support being connected with the worm drive.

4. An apparatus according to claim 3 further comprising a transport lever positioned adjacent the support for biasing the roll core off the support when the support is located in a discharge position.

5. An apparatus according to claim 1, wherein the guiding drum includes a surface and wherein the surface of the guiding drum is roughened.

6. An apparatus according to claim 1, wherein the roll core carrying arm pivot is positioned at a predetermined distance from the axis of rotation of the guiding drum so that the roll core is maintained in contact with the driven by the guiding drum throughout movement of the carrying arm from the carrying position to the unloading position.

7. An apparatus according to claim 6, wherein each of the roll core carrying arm and guiding drum are constructed and arranged to direct a leading end of the web into contact with a roll core positioned in the carrying arm so that an initial winding of web is formed on the roll core, the guiding drum contacting a surface of the web on the roll core to rotate the roll core to wind the web thereonto.

8. An apparatus for forming a continuous winding of a web from a source onto a roll core comprising:

a roll core support, the support being movable from a loading position, wherein a roll core is loaded onto the support to a supporting position, wherein the roll core is located on the support during winding of the web onto the roll core to form a winding, to a discharge position, wherein the roll core having a completed winding is discharged from the roll core support;

a rotating guiding drum positioned adjacent and remote from the roll core support;

a first drive for rotating the guiding drum;

a movable pressing roll biased against a side of the winding when the winding is positioned in the support so that the web forms a winding on the roll core substantially free of air bubbles in the winding;

a sensor, interconnected with the pressing roll, the sensor detecting an increase in a size of the winding and the sensor generating a signal in response to the increase in size;

a second drive for moving the roll core support in response to the signal to change the position of the roll core relative to the pressing roll, the second drive maintaining the winding remote from and out of contact with the guiding drum when the roll core is in the supporting position;

a third drive for rotating the roll core on the support;

a roll core carrying arm constructed and arranged so that a roll core located in the carrying arm rotates in conjunction with and in response to rotation of the guiding drum, the carrying arm including a pivot proximate and substantially parallel to an axis of rotation of the guiding drum, the arm moving on the pivot between a carrying position remote from the roll core support to an unloading position wherein the roll core is transferred onto the roll core support in the loading position, the carrying arm and guiding drum being further constructed and arranged so that a leading end of a web from the source engages the roll core in the carrying position and is wound to form an initial winding on the roll core as the roll core rotates in conjunction with the rotation of the guiding drum, the web of the initial winding contacting the guiding drum and being rotated thereby, the roll core with the initial winding being transferred onto the roll core support in the loading position, the guiding drum further constructed and arranged to guide the web from the source onto the winding of the roll core when the roll core is positioned on the support in the supporting position.

9. A method for winding a continuous web from a source onto a roll core comprising the steps of:

locating a roll core on a pivoting carrying arm, the roll core being rotated by a guiding drum in contact with the carrying arm;

providing a leading end of the web from the source between the guiding drum and the roll core on the carrying arm, the roll core on the carrying arm engaging the leading end and forming an initial winding of web on the roll core as the roll core is rotated by the guiding drum, the web on the winding continuously contacting the guiding drum to continuously rotate the roll core;

positioning a roll core support adjacent the guiding drum in a loading position;

pivoting the carrying arm having the roll core with the initial winding in contact with the guiding drum, the roll core with the initial winding being rotated thereby during pivoting, into a discharge position wherein the roll core with the initial winding is transferred onto the support in the loading position;

moving the support, subsequent to transfer of the roll core with the initial winding thereonto, from the loading position to a supporting position and rotating the roll core on the support remote from the guiding drum;

continuously moving the support away form the guiding drum in response to an increase in size of the winding formed on the support in the supporting position so as to maintain the winding out of contact with the guiding drum, the guiding drum continuously guiding the web onto the winding while the roll core is positioned on the support;

discharging a roll core having a completed winding when the winding reaches a predetermined size; and loading another roll core onto the carrying arm so as to form another initial winding for transfer onto the support.

* * * * *